US005869227A

United States Patent [19]

Majumdar et al.

[11] Patent Number: 5,869,227

[45] Date of Patent: Feb. 9, 1999

[54] ANTISTATIC LAYER WITH SMECTITE CLAY AND AN INTERPOLYMER CONTAINING VINYLIDENE HALIDE

[75] Inventors: Debasis Majumdar; Dwight W. Schwark, both of Rochester; Charles C. Anderson, Penfield, all of N.Y.

[73] Assignee: Eastman Kodak Company, Rochester, N.Y.

[21] Appl. No.: 992,857

[22] Filed: Dec. 18, 1997

[51] Int. Cl.[6] ..... G03C 1/89

[52] U.S. Cl. ..... 430/527; 430/531; 430/534; 430/535; 430/536

[58] Field of Search ..... 430/527, 531, 430/536, 534, 535

[56] References Cited

U.S. PATENT DOCUMENTS

| | | | |
|---|---|---|---|
| 4,173,480 | 11/1979 | Woodward | 430/127 |
| 4,442,168 | 4/1984 | White et al. | 428/331 |
| 4,571,365 | 2/1986 | Ashlock et al. | 428/412 |
| 4,582,784 | 4/1986 | Fukugawa et al. | 430/531 |
| 4,735,976 | 4/1988 | Steklenski et al. | 524/32 |
| 5,204,219 | 4/1993 | Van Ooij et al. | 430/523 |
| 5,236,818 | 8/1993 | Carlson | 430/527 |
| 5,478,709 | 12/1995 | Vandenabeele | 430/527 |
| 5,494,738 | 2/1996 | Van Thillo et al. | 430/527 |

FOREIGN PATENT DOCUMENTS

| | | |
|---|---|---|
| 0 250 154 A3 | 12/1987 | European Pat. Off. . |
| 0 301 827 B1 | 2/1989 | European Pat. Off. . |
| 0 644 454 B1 | 3/1995 | European Pat. Off. . |

*Primary Examiner*—Richard L. Schilling
*Attorney, Agent, or Firm*—Carl F. Ruoff

[57] ABSTRACT

The present invention is an imaging element which includes a support, an image forming layer superposed on the support, and an electrically conducting layer. The electrically conducting includes smectite clay at a weight percent of from 5 to 95% and an interpolymer of vinylidene halide at a weight percent of from 95 to 5%.

12 Claims, No Drawings

ANTISTATIC LAYER WITH SMECTITE CLAY AND AN INTERPOLYMER CONTAINING VINYLIDENE HALIDE

FIELD OF THE INVENTION

This invention relates in general to imaging elements, such as photographic, electrostatographic, and thermal imaging elements, and in particular to imaging elements comprising a support, an image forming layer and an electrically conductive layer. More specifically, this invention relates to electrically conductive layers containing a conducting smectite clay and a film forming binder and to the use of such layers in imaging elements as to provide protection against the accumulation of static electrical charges or serving as an electrode which takes part in an image forming process as well as providing protection against hard-water scumming encountered during photographic processing.

BACKGROUND OF THE INVENTION

The problem of controlling static charge is well known in the field of photography. The accumulation of charge on film or paper surfaces leads to the attraction of dirt which can produce physical defects. The discharge of accumulated charge during or after the application of the sensitized emulsion layer(s) can produce irregular fog patterns or "static marks" in the emulsion. Static problems have been aggravated by the increase in the sensitivity of new emulsions, the increase in coating machine speeds, and the increase in post-coating drying efficiency. The charge generated during the coating process may accumulate during winding and unwinding operations, during transport through the coating machines and during finishing operations such as slitting and spooling. Static charge can also be generated during the use of the finished photographic film product. In an automatic camera, the winding of roll film in an out of the film cartridge, especially in a low humidity environment, can result in static charging. Similarly, high speed automated film processing can result in static charge generation. Sheet films (e.g., x-ray films) are especially susceptible to static charging during removal from light-tight packaging.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color or reduced transparency, increased brittleness and poor adhesion, to the antistatic layer.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

The requirements for antistatic layers in silver halide photographic films are especially demanding because of the stringent optical requirements. Other types of imaging elements such as photographic papers and thermal imaging elements also frequently require the use of an antistatic layer. However, the requirements there maybe somewhat different. For example, for photographic paper, an additional criterion is the ability of the antistatic backing layer to receive printing (e.g., bar codes or other indicia containing useful information) typically administered by dot matrix or inkjet printers and to retain these prints or markings as the paper undergoes processing (viz, backmark retention). Yet another important criterion for photographic paper is its spliceability. Heat splicing of photographic paper rolls is often carried out during printing operations and is expected to provide enough mechanical strength to resist peeling as the web goes through automatic photographic processing. Heat splicing is typically carried out between the silver halide side of the paper and the antistatic backside of the paper. Poor splice strength can cause a number of problems including jamming of automatic processing equipment.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are environmentally benign, which are durable and abrasion-resistant, which are effective at low coverage, which are adaptable to use with transparent imaging elements, which do not exhibit adverse sensitometric or photographic effects, and which maintain electrical conductivity even after coming in contact with processing solutions (since it has been observed in industry that loss of electrical conductivity after processing may increase dirt attraction to processed films which, when printed, may cause undesirable defects on the prints).

In addition to controlling static charging, auxiliary layers applied to photographic elements also provide many other functions. These include providing resistance to abrasion, curl, solvent attack, halation and providing reduced friction for transport. One additional feature that an auxiliary layer must provide when the layer serves as the outermost layer is resistance to the deposition of material onto the element upon photographic processing. Such material can impact the physical performance of the element in a variety of ways. For example, large deposits of material on a photographic film lead to readily visible defects on photographic prints or are visible upon display of motion picture film. Alternatively, post-processing debris can influence the ability of a processed film to be overcoated with an ultraviolet curable abrasion resistant layer, as is done in professional photographic processing laboratories employing materials such as PhotoGard, 3M. Finally, processing residue on photographic elements can impact the ability to read magnetically recorded information on a processed film, such as the new advanced photographic system films.

The final step for many photographic processing sequences is the stabilization or final rinse bath. While the components of this final solution vary depending upon the type of photographic material being processed, it is common practice to include one or more surfactants in the final solution. The surfactants are included to improve the wetting of the photographic media being processed. Such wetting should reduce the tendency to form spots upon drying of the media.

While the surfactants in the final processing solution can assist with the wetting of the media, an objectionable surface haze or scum may still appear on the media after processing. Prior art has shown that the outer surface of the media must consist of blends of hydrophobic and hydrophilic materials. U.S. Pat. No. 4,735,976 teaches the use of blends of cellulose nitrate and an interpolymer containing a hydrophobic monomer and an acid monomer to prevent scumming by surfactants in the processing solutions. To prevent spotted drying unevenness after processing, U.S. Pat. No. 4,582,784 teaches the use of blends of cellulosic esters with hydrophilic interpolymers or homopolymers. E.P. 0 644 454 A1 teaches the use of a two layer system that avoids the occurrence of water spot defects after processing. The outermost layer contains a polyoxyalkylene compound as an antistatic agent, while the underlying antistress layer contains a hydrophilic colloid and at least one synthetic clay.

One type of processing scum that is particularly troublesome is hard-water scum. Processing laboratories that are located in hard-water areas are particularly susceptible to this problem. After processing in solutions prepared using hard-water, a white hazy surface scum, sometimes uniform and sometimes more liney and streaky, can be seen on the film. Chemical analysis of the hard-water scum typically reveals hard-water salts of calcium, magnesium, and sodium. As mentioned previously, such a hard-water scum can lead to printable defects or interfere with subsequent coating or magnetic reading operations.

It is toward the objective of providing improved electrically-conductive layers that more effectively meet the diverse needs of imaging elements—especially of silver halide photographic films but also of a wide range of other imaging elements—than those of the prior art that the present invention is directed.

The antistatic layer of the present invention comprises an electrically conducting smectite clay as component A and a hydrophobic, film forming binder comprising an interpolymer of vinylidene halide as component B.

Use of smectite clay in imaging elements has been disclosed before. For example, in European Patent Application 0644454A1 use of synthetic clay in an antistress layer for x-ray films has been disclosed. In U.S. Pat. No. 5,478,709, the use of synthetic clay in the silver halide emulsion layer for reduction in roller marks during automatic processing has been described. The use of synthetic hectorite as an additive to a silica containing antistatic layer has been proposed before in U.S. Pat. No. 4,173,480 and U.S. Pat. No. 5,494,738. However, the integrity of these layers, when present as external layers, in contact with processing solutions during high speed processing is likely to be minimal resulting in loss of post-processing antistatic characteristic. In fact, some of the drawbacks of external antistatic layers containing a combination of hectorite clay and silica applied on photographic paper have been described in commonly assigned copending application U.S. Ser. No. 08/937,685 filed Sep. 29, 1997. Although some binders have been mentioned in U.S. Pat. No. 4,173,480 for their use in conjunction with hectorite clay for application as a surface sizing agent for the fibrous paper base, the binders mentioned therein are hydrophilic binders such as gelatin, starch and methyl cellulose which are likely to offer little resistance to the processing solutions. Again, some of the drawbacks of external antistatic layers containing a combination of hectorite clay and these suggested binders applied on photographic paper have been described in commonly assigned copending application U.S. Ser. No. 08/937,685. The use of an organic compound which can intercalate inside and/or exfoliate smectite clay has been taught in commonly assigned copending applications U.S. Ser. No. 08/937,685 and 08/940,860 for application in antistatic layers containing smectite clay. However, as demonstrated later, antistatic layers, as per the teachings of these patent applications, do not retain sufficient post-process conductivity. Thus the prior art for antistatic layers comprising clay, suitable for imaging elements, is quite inadequate.

As will be demonstrated later, the present invention provides an antistatic layer which is a simple two component system comprising a smectite clay and a hydrophobic, film forming binder which is an interpolymer of vinylidene halide wherein the said antistatic layer unexpectedly provides certain advantages over the teachings of the prior art including the retention of antistatic properties after photographic processing and the prevention of hard-water scum formation after photographic processing.

SUMMARY OF THE INVENTION

The present invention is an imaging element which includes a support, an image forming layer superposed on the support, and an electrically conducting layer. The electrically conducting includes smectite clay at a weight percent of from 5 to 95% and an interpolymer of vinylidene halide at a weight percent of from 95 to 5%.

DETAILED DESCRIPTION OF THE INVENTION

The antistatic layer of the present invention comprises an electrically conducting smectite clay as component A and a hydrophobic, film forming binder which is an interpolymer of vinylidene halide as component B. When used as an external layer, such an antistatic layer provides a surface electrical resistivity (SER) of less than 12 log ohms/square in an ambient of 50% relative humidity, but preferably between 7.5–10 log ohms/square. Additionally, such an antistatic layer provides adequate SER of less than 12 log ohms/square, but preferably between 8–11 log ohms/square, after undergoing a typical black and white photographic film processing. More over, such an antistatic layer provides resistance to hard-water scumming typically observed on processed photographic films.

The clay material, component A, used in this invention is an electrically conducting smectite clay, preferably a synthetic smectite which closely resembles the natural clay mineral hectorite in both structure and composition. Hectorite is a natural swelling clay which is relatively rare and occurs contaminated with other minerals such as quartz which are difficult and expensive to remove. Synthetic smectite is free from natural impurities, prepared under controlled conditions. One such synthetic smectite is commercially marketed under the tradename Laponite by Laporte Industries, Ltd of UK through its US subsidiary, Southern Clay Products, Inc. It is a layered hydrous magnesium silicate, in which magnesium ions, partially replaced by suitable monovalent ions such as lithium, sodium, potassium and/or vacancies, are octahedrally coordinated to oxygen and/or hydroxyl ions, some of which may be replaced by fluorine ions, forming the central octahedral sheet; such an octahedral sheet is sandwiched between two tetrahedral sheets of silicon ions, tetrahedrally coordinated to oxygen.

There are many grades of Laponite such as RD, RDS, J, S, etc. each with unique characteristics and can be used for the present invention, as long as they maintain their electrical conductivity. Some of these products contain a polyphosphate peptizing agent such as tetrasodium pyrophosphate for rapid dispersion capability; alternatively, a suitable peptizer can be incorporated into Laponite later on for the same purpose. A typical chemical analysis of Laponite RDS and its physical properties, as per Laponite Product Bulletin, are provided below.

TABLE 1

Typical Chemical Analysis

| Component | Weight % |
|---|---|
| $SiO_2$ | 54.5 |
| MgO | 26.0 |
| $Li_2O$ | 0.8 |
| $Na_2O$ | 5.6 |
| $P_2O_5$ | 4.1 |
| Loss on ignition | 8.0 |

TABLE 2

Typical Physical Properties

| | |
|---|---|
| Appearance | White Powder |
| Bulk density | 1000 kg/m$^3$ |
| Surface Area | 330 m$^2$/g |
| pH (2% suspension) | 9.7 |
| Sieve analysis, | 98% < 250$\mu$ |
| Moisture content | 10% |

Laponite separates into tiny platelets of lateral dimension of 25–50 nm and a thickness of 1–5 nm in deionized aqueous dispersions, commonly referred to as "sols." Typical concentration of Laponite in a sol can be 0.1% through 10%. During dispersion in deionized water an electrical double layer forms around the clay platelets resulting in repulsion between them and no structure build up. However, in a formulation containing electrolytes introduced from tap water or other ingredients, the double layer can be reduced resulting in attraction between the platelets forming a "House of Cards" structure.

In commonly assigned copending applications U.S. Ser. No. 08/937,685 and 08/940,860 it was discovered that polymeric binders capable of sufficiently intercalating inside and/or exfoliating electrically conducting smectite clay can be used with the clay to form antistatic layers for imaging elements. Polymeric binders capable of "sufficiently" intercalating inside the smectite clay are defined to be those which can increase the basal plane spacing (as measured by x-ray diffraction technique) of the said clay by at least 50%, when the clay/binder ratio is changed from 100/0 to 30/70. The hydrophobic, film forming binder which is an interpolymer of vinylidene halide, chosen as component B for the present invention, was found not to fulfill this criterion and is thus beyond the teachings of the aforementioned commonly assigned copending applications. In commonly assigned copending application Ser. No. 08/939,815 it was taught that antistatic layers comprising smectite clay and a film forming binder which does not intercalate inside and/or exfoliate the smectite clay but with a glass transition temperature (Tg) less than 30° C., fulfill the various performance requirements of photographic paper. According to the present invention, however, it was discovered that the hydrophobic, film forming binder which is an interpolymer of vinylidene halide, chosen as component B, does not necessarily have to have a Tg less than 30° C. and is outside the scope of the teachings of U.S. Ser. No. 08/939,815.

The hydrophobic, film forming binder (component B) used for the purpose of the present invention, is an interpolymer of a vinylidene halide such as vinylidene fluoride, vinylidene chloride, vinylidene bromide, etc. with other ethylenically unsaturated monomers including alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrenecarboxylic acid. The weight % of vinylidene halide in the interpolymer is from about 20% to about 98%, and preferably from about 50% to about 98%. The interpolymers used in the present invention have a glass transition temperature less than 70° C., and preferably less than 50° C.

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly (vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly(ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, Research Disclosure, June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", Xerox Disclosure Journal, Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force. An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, Electrophotography, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing stem may also be needed, depending on the exposure levels.

Another example of imaging elements which employ an antistatic layer are dye-receiving elements used in thermal dye transfer systems. Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

In a particularly preferred embodiment, the imaging element of this invention is a photographic element that includes an image-forming layer which is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a photographic paper bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. Details regarding supports and other layers of the photographic elements of this invention are contained in Research Disclosure, Item 38957, September 1996, Research Disclosure, Item 36544, September, 1994 and Research Disclosure, Item 37038, February 1995 incorporated herein by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 38957, September 1996 and Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

In addition to binders and solvents, other components that are well known in the photographic art may also be present in the electrically-conductive layer. These additional components include: surfactants and coating aids, thickeners, coalescing aids, crosslinking agents or hardeners, soluble and/or solid particle dyes, antifoggants, matte beads, lubricants, and others.

The formulated dispersions can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating. Alternatively, the antistatic layer or layers of the present invention can be applied to a single or multilayered polymeric web by any of the aforementioned methods, and the polymeric web can subsequently be laminated to a film or paper support of an imaging element (such as those discussed above) by extrusion, calendering or any other suitable method.

The antistatic layer or layers of the present invention can be applied to the support in various configurations depending upon the requirements of the specific application. In the case of photographic elements for graphics arts application, an antistatic layer can be applied to a polyester film base during the support manufacturing process after orientation of the cast resin on top of a polymeric undercoat layer. The antistatic layer can be applied as a subbing layer under the sensitized emulsion, on the side of the support opposite the emulsion or on both sides of the support. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The antistatic layer would typically be located closest to the support. An intermediate layer, containing primarily binder and antihalation dyes functions as an antihalation layer. The outermost layer containing binder, matte, and surfactants functions as a protective overcoat. Other addenda, such as polymer latices to improve dimensional stability, hardeners or crosslinking agents, and various other conventional additives can be present optionally in any or all of the layers.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

The conductive layer of this invention may also be used as the outermost layer of an imaging element, for example, as an abrasion-resistant backing layer applied on the side of the film support opposite to the imaging layer. It is in such an outermost position that the prevention of hard-water scumming is achieved.

It is also contemplated that the electrically-conductive layer described herein can be used in imaging elements in which a relatively transparent layer containing magnetic particles dispersed in a binder is included. The electrically-conductive layer of this invention functions well in such a combination and gives excellent photographic results. Transparent magnetic layers are well known and are described, for example, in U.S. Pat. No. 4,990,276, European Patent 459,349, and Research Disclosure, Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range of typical lay-down.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove.

The relative amount of the electrically conducting smectite clay (component A) can vary from 5–95 weight % and the relative amount of the hydrophobic, film forming binder which is an interpolymer of vinylidene halide (component B) can vary from 95–5 weight % in the dried layer. In a preferred embodiment of this invention the amount of smectite clay should be 10–70 weight % and the hydrophobic, film forming binder which is an interpolymer of vinylidene halide should be 90–30 weight % in the dried layer. The coating composition is coated at a dry weight coverage of between 10 mg/m$^2$ and 10,000 mg/m$^2$, preferably between 200–2000 mg/m$^2$.

The present invention is further illustrated by the following examples of its practice.

SAMPLE PREPARATION

Film based web

Polyester film base that had been previously coated with a subbing layer of vinylidene chloride-acrylonitrile-acrylic acid terpolymer latex was used as the web on which aqueous coatings were applied through hopper coating. The coatings were dried at 250° F. The coating coverage varied between 300 mg/m$^2$ and 1000 mg/m$^2$ when dried. Some of these coatings were overcoated with a solvent coated layer of polymethylmethacrylate or cellulose diacetate.

Paper based web

Corona-discharge treated polyolefin coated paper base was used as the web on which aqueous coatings were applied through hopper coating. The coatings were dried at 180° F. The coating coverage varied between 300 mg/m$^2$ and 600 mg/m$^2$ when dried.

TEST METHODS

For resistivity tests, samples are preconditioned at 50% RH 72° F. for at least 24 hours prior to testing. Surface electrical resistivity (SER) is measured with a Keithly Model 616 digital electrometer using a two point DC probe by a method similar to that described in U.S. Pat. No. 2,801,191. Internal resistivity or "water electrode resistivity" (WER) was measured by the procedures described in R. A. Elder, "Resistivity Measurements on Buried Conductive Layers", EOS/ESD Symposium proceedings, September 1990, pages 251–254.

For hard-water scum formation tests, samples are processed in color photographic chemistry, such as C-41 processing. After processing, the dry strips are dipped into a C-41 stabilizer solution doctored with 500 ppm $CaCO_3$ equivalent, prepared by adding $CaCl_2$ and $NaHCO_3$ to the stabilizer solution. After dipping, the strips are hung to air-dry without rinsing or squeegying to remove excess liquid. The dried strips are evaluated under reflected and transmitted light for the presence of surface haze or scum.

For backmark retention tests on photographic paper, a printed image is applied onto the coated papers prepared as above using a pre-process ribbon print. The paper is then subjected to a conventional developer for 30 seconds, washed with warm water for 5 seconds and rubbed for print retention evaluation. The following ratings are assigned, with numbers 1–3 indicating acceptable performance.

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

For splice strength measurement for photographic paper, the backside of a strip of photographic paper containing the coating of interest is placed with 6–8 mm of overlap on the silver halide containing side of a similar strip of photographic paper and heated in a custom made set up for 4 seconds under 40 psi of pressure, replicating the conditions used by commercially available equipment used for heat splicing of photographic paper. The strength of the resultant splice is determined in an Instron machine as the force (measured in grams) necessary to peel the two strips apart, using a crosshead speed of 50 mm/min. A peel strength of 40–100 gm is considered adequate for acceptable performance.

COMPARATIVE SAMPLES

The following samples 1–12 were coated as per the teachings of the present invention onto a subbed polyester support. In all these samples Laponite RDS was used as component A and a latex polymer X which is a terpolymer of acrylonitrile, vinylidene chloride and acrylic acid in the weight ratio of 15/79/6 and having a glass transition temperature of 42° C. was used as component B. As shown clearly in the following two tables, layers coated per the present invention for a wide range of component A/component B weight ratios and coverage provide excellent SER values.

| Sample | Component A Laponite RDS dry wt. % | Component B Latex polymer X dry wt. % | Coverage mg/m$^2$ | SER log ohm/square |
|---|---|---|---|---|
| 1 | 30 | 70 | 600 | 10.1 |
| 2 | 40 | 60 | 600 | 8.8 |
| 3 | 50 | 50 | 600 | 8.3 |
| 4 | 60 | 40 | 600 | 8 |
| 5 | 70 | 30 | 600 | 7.7 |
| 6 | 80 | 20 | 600 | 7.5 |
| 7 | 70 | 30 | 300 | 8.1 |
| 8 | 70 | 30 | 400 | 7.9 |
| 9 | 70 | 30 | 600 | 7.7 |
| 10 | 70 | 30 | 800 | 7.5 |
| 11 | 70 | 30 | 1000 | 7.3 |
| 12 | 70 | 30 | 1500 | 7.1 |

The following samples 13–16 were coated as per the teachings of the present invention onto a subbed polyester support. In all these samples Laponite RDS was used as component A and the latex polymer X described before was used as component B. These samples were tested for hard-water scum level, and, as shown clearly in the following table, layers coated per the present invention for a wide range of component A/component B weight ratios provide excellent resistance against hard-water scum.

| Sample | Component A Laponite RDS dry wt. % | Component B Latex polymer X dry wt.% | Coverage mg/m$^2$ | Hard-Water Scum Level |
|---|---|---|---|---|
| 13 | 30 | 70 | 600 | None |
| 14 | 20 | 80 | 600 | None |
| 15 | 15 | 85 | 600 | None |
| 16 | 10 | 90 | 600 | None |

COMPARATIVE SAMPLE

Sample 17 was a subbed polyester support which was not coated with a layer of the invention and was used as a comparative sample. As shown in the following table, sample 17 resulted in heavy scum and is clearly inferior to samples 13–16, prepared as per the present invention. This sample also did not provide any antistatic properties.

| Sample | Description | Hard-Water Scum Level |
|---|---|---|
| 17 | subbed polyester support only | Heavy |

WORKING EXAMPLES

The following samples 18–26 were coated as per the teachings of the present invention onto a subbed polyester support. In all these samples Laponite RDS was used as component A and a latex polymer Y which is a terpolymer of methyl acrylate, vinylidene chloride and itaconic acid in the weight ratio 15/83/2 and having a glass transition temperature of 24° C. was used as component B. As shown clearly in the following two tables, layers coated per the present invention for a wide range of component A/component B weight ratios and coverage provide excellent SER values.

| Sample | Component A Laponite RDS dry wt. % | Component B Latex polymer Y dry wt.% | Coverage mg/m$^2$ | SER log ohm/square |
|---|---|---|---|---|
| 18 | 20 | 80 | 600 | 10.3 |
| 19 | 30 | 70 | 600 | 8.9 |
| 20 | 50 | 50 | 600 | 7.8 |
| 21 | 65 | 35 | 600 | 7.4 |
| 22 | 70 | 30 | 50 | 9.0 |
| 23 | 70 | 30 | 100 | 8.5 |
| 24 | 70 | 30 | 300 | 7.7 |
| 25 | 70 | 30 | 600 | 7.2 |
| 26 | 70 | 30 | 1000 | 6.8 |

The following samples, 27 and 28, were coated as per the teachings of the present invention onto a subbed polyester support. In these samples Laponite RDS was used as component A and the latex polymer Y described before was used as component B. As shown clearly in the following table, layers coated per the present invention provide excellent resistance against hard-water scum.

| Sample | Component A Laponite RDS dry wt. % | Component B Latex polymer Y dry wt. % | Coverage mg/m$^2$ | Hard-Water Scum Level |
|---|---|---|---|---|
| 27 | 30 | 70 | 600 | None |
| 28 | 15 | 85 | 600 | None |

WORKING EXAMPLES

Some of the aforesaid samples, 2, 5, 19–21 were subjected to a typical black and white film processing and subsequently tested for surface electrical resistivity. This was done to check the post-processing conductivity of the antistatic layers. As shown in the table below, these samples retained low enough SER values after black and white processing to be effective as process-surviving antistatic layers.

| Sample | Pre-processing SER log ohm/square | Post-processing SER log ohm/square |
|---|---|---|
| 2 | 8.8 | 10.1 |
| 5 | 7.7 | 8.4 |
| 19 | 8.9 | 10.3 |
| 20 | 7.8 | 9.1 |
| 21 | 7.4 | 8.7 |

COMPARATIVE SAMPLES

The following samples 29–32 were coated onto a subbed polyester support with Laponite RDS as component A and a polymeric dispersion V, which is a polyester ionomer AQ55D supplied by Eastman Chemicals Company, as component B. The polymeric dispersion AQ55D is chosen as component B based per the teachings of commonly assigned copending U.S. Ser. No. 08/937,685. It is clear that samples 29–32 have much higher SER values than the samples 2–5 which were coated as per the present invention (for equivalent dry weight % of Laponite, component A). Thus one can easily conclude that samples prepared per the present invention are much superior to those prepared per the teachings of commonly assigned copending U.S. Ser. No. 08/937,685.

| Sample | Component A Laponite RDS dry wt % | Component B Polymer V dry wt. % | Coverage mg/m$^2$ | SER log ohm/square |
|---|---|---|---|---|
| 29 | 40 | 60 | 600 | 11.4 |
| 30 | 50 | 50 | 600 | 10.3 |
| 31 | 60 | 40 | 600 | 9.5 |
| 32 | 70 | 30 | 600 | 8.7 |

Samples 29 and 32 were subjected to a typical black and white processing (same as the one used for samples, 2, 5, 19–21) and subsequently tested for surface electrical resistivity. This was done to check the post-processing conductivity of the antistatic layers. As shown in the table below, both samples resulted in SER values greater than 12 log ohms/square after the black and white processing and are clearly inferior to samples 2,5, 19–21 coated per the teachings of the present invention.

| Sample | Pre-processing SER log ohm/square | Post-processing SER log ohm/square |
|---|---|---|
| 29 | 11.4 | >13.9 |
| 32 | 8.7 | 12.5 |

WORKING EXAMPLES

The following samples 33–39 were coated, onto a subbed polyester support with Laponite RDS as component A and latex Y, described earlier, as component B as per the teachings of the present invention as buried antistatic layers which were subsequently overcoated with a layer of either polymethylmethacrylate, supplied as Elvacite 2041 by ICI Acrylics, or cellulose diacetate. Both polymethylmethacrylate and cellulose diacetate are well known in the imaging and photographic art for their application as abrasion resistant overcoats. As indicated in the following table, all these samples provided adequate internal resistivity values (WER) to illustrate the use of the present invention as buried antistatic layers.

| Sample | Composition of buried layer Laponite RDS (comp. A): latex Y (comp B) | Coverage of buried layer mg/m$^2$ | Composition of overcoated layer | Coverage of overcoated layer mg/m$^2$ | WER, after overcoating log ohm/square |
|---|---|---|---|---|---|
| 33 | 70:30 | 300 | polymethyl methacrylate | 1000 | 8.8 |
| 34 | 70:30 | 600 | polymethyl methacrylate | 1000 | 8.2 |
| 35 | 70:30 | 1000 | polymethyl methacrylate | 1000 | 8.3 |
| 36 | 50:50 | 1000 | polymethyl methacrylate | 1000 | 8.6 |
| 37 | 40:60 | 1000 | polymethyl methacrylate | 1000 | 8.9 |
| 38 | 50:50 | 300 | cellulose diacetate | 1000 | 9.4 |
| 39 | 40:60 | 600 | cellulose diacetate | 1000 | 9.6 |

Some of the aforesaid samples, 33–35, 38 and 39 were subjected to a typical color processing, such as C-41 processing, and subsequently tested for internal resistivity (WER). This was done to check the post-process conductivity of the buried antistatic layers. As shown in the table below, these samples retained low enough WER values after color processing to be effective as process-surviving buried antistatic layers.

| Sample | Pre-processing WER log ohm/square | Post-processing WER log ohm/square |
|---|---|---|
| 33 | 8.8 | 8.3 |
| 34 | 8.2 | 8.0 |
| 35 | 8.3 | 8.0 |
| 38 | 9.4 | 9.8 |
| 39 | 9.6 | 9.5 |

WORKING EXAMPLES

The following samples were coated on photographic paper with Laponite RDS as component A and latex X described before as component B. Latex X has a Tg of approximately 42° C. and therefore falls outside the teachings of commonly assigned copending U.S. Ser. No. (Docket 76,371). It is clear that these samples prepared as per the current invention exhibit good SER, backmark retention and splice strength desired of photographic paper. This demonstrates the unexpected result that vinylidene halide interpolymers of the present invention having a Tg higher than 30° C. form antistatic backings with desirable characteristics for photographic paper.

| Sample | Component A Laponite RDS dry wt. % | Component B Latex polymer X dry wt. % | Coverage mg/m$^2$ | SER log ohm/ square | Backmark retention | Splice strength peel force, g |
|---|---|---|---|---|---|---|
| 40 | 40 | 60 | 300 | 9.7 | 3 | 149 |
| 41 | 50 | 50 | 300 | 9.1 | 3 | 107 |

COMPARATIVE SAMPLE

The following samples were coated on photographic paper with Laponite RDS as component A and a latex Z containing styrene-co-butyl methacrylate-co-sodium-2-sulfoethyl methacrylate in the ratio of 60/30/10 with a Tg of 41° C. as described in Table I column 4 of U.S. Pat. No. 5,244,728, as component B. This latex was chosen because of its Tg being very close to that of latex X described before. The important difference is that latex X comprises a vinylidene halide interpolymer, a crucial ingredient as per the present invention, whereas latex Z, described in U.S. Pat. No. 5,244,728, does not. As clearly shown in the following table, these samples, comprising latex Z, resulted in completely unacceptable backmark retention characteristic. This demonstrates that the absence of vinylidene halide interpolymer in component B results in inferior antistatic layers compared to those prepared per the present invention.

| Sample | Component A Laponite RDS dry wt. % | Component B Latex polymer Z per U.S. Pat. 5,244,728 dry wt. % | Coverage mg/m$^2$ | SER log ohm/ square | Backmark retention |
|---|---|---|---|---|---|
| 42 | 60 | 40 | 400 | 8.5 | 5 |
| 43 | 70 | 30 | 400 | 8.0 | 5 |

The invention has been described in detail with particular reference to certain preferred embodiments thereof, but it will be understood that variations and modifications can be effected within the spirit and scope of the invention.

What is claimed is:

1. An imaging element comprising:

a support;

an image forming layer superposed on the support; and an electrically conducting layer comprising:

an electrically conducting smectite clay at a weight percent of from 5 to 95% and an interpolymer of vinylidene halide at a weight percent of from 95 to 5%.

2. The imaging element of claim 1, wherein said electrically conducting smectite clay comprises a synthetic hectorite clay.

3. The imaging element of claim 2, wherein said synthetic hectorite clay comprises a layered hydrous magnesium silicate.

4. The imaging element of claim 1, wherein said interpolymer of vinylidene halide comprises a vinylidene halide selected form the group consisting of vinylidene fluoride, vinylidene chloride, vinylidene bromide and an ethylenically unsaturated monomer selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinyl chloride, vinyl aromatic compounds, dialkyl maleates, dialkyl itaconates, dialkyl methylene-malonates, isoprene, and butadiene.

5. The imaging element of claim 4, wherein said interpolymer of vinylidene halide comprises from 20% to about 98% of weight vinylidene halide.

6. The imaging element of claim 4, wherein said interpolymer of vinylidene halide comprises from 50% to about 98% of weight vinylidene halide.

7. The imaging element of claim 1, wherein said interpolymer of vinylidene halide has a glass transition temperature less than 70° C.

8. The imaging element of claim 1, wherein said support is selected from the group consisting of cellulose nitrate films, cellulose acetate films, poly(vinyl acetal) films, polystyrene films, poly(ethylene terephthalate) films, poly (ethylene naphthalate) films, polycarbonate films, glass, metals, papers and polymer-coated paper.

9. The imaging element of claim 1, wherein said electrically conducting layer further comprises crosslinking agents, surfactants, thickeners, coalescing aids, particle dyes, matte beads or lubricants.

10. The imaging element of claim 1, wherein said electrically conductive layer comprises an outermost layer.

11. The imaging element of claim 1 wherein the electrically conductive layer has a dry weight coverage of between 10 mg/M$^2$ and 10,000 mg/m$^2$, preferably between 200–2000 mg/m$^2$.

12. The imaging element of claim 1, wherein the weight percent of smectite clay is from 10 to 70 percent and the weight percent of the interpolymer of vinylidene halide is from 30 to 90 percent.

* * * * *